United States Patent [19]

Yamaguchi

[11] 4,357,256

[45] Nov. 2, 1982

[54] SODIUM HYDROSULFITE COMPOSITION

[75] Inventor: Takaaki Yamaguchi, Tokyo, Japan

[73] Assignee: Mitsubishi Gas Chemical Company, Inc., Tokyo, Japan

[21] Appl. No.: 128,098

[22] Filed: Mar. 7, 1980

[30] Foreign Application Priority Data

Mar. 13, 1979 [JP] Japan ..... 54-29186

[51] Int. Cl.[3] ..... C09K 3/00

[52] U.S. Cl. ..... 252/188.24; 162/80; 162/83; 8/107; 8/110; 423/512 R; 423/515

[58] Field of Search ..... 252/188, 105; 162/80, 162/83; 8/107, 110; 423/512 R, 515

[56] References Cited

U.S. PATENT DOCUMENTS

| | | | |
|---|---|---|---|
| 3,653,804 | 4/1972 | Janson et al. | 252/188 |
| 3,666,409 | 5/1972 | Yoshikawa et al. | 252/188 |
| 3,669,895 | 6/1972 | Shasti | 252/188 |

*Primary Examiner*—Joseph L. Schofer
*Assistant Examiner*—J. L. Barr
*Attorney, Agent, or Firm*—Armstrong, Nikaido, Marmelstein & Kubovcik

[57] ABSTRACT

A bleaching composition comprises sodium hydrosulfite, hexamethylenetetramine and a water soluble sulfite such as sodium sulfite or ammonium sulfite, or further a polyphosphate such as a pyrophosphate or a tripolyphosphate and is used in bleaching pulp with a good bleaching effect with no substantial hydrogen sulfide generation.

6 Claims, No Drawings

SODIUM HYDROSULFITE COMPOSITION

The present invention relates to a sodium hydrosulfite composition.

Sodium hydrosulfite is a water-soluble, strong reducing agent and widely utilized in industrial fields as a pulp bleaching agent, or in vat dying of fibers with vat dye and sulfide dye, reduction cleaning of polyester fibers, bleaching of food, etc. In these applications, sodium hydrosulfite is generally utilized in the form of an aqueous solution. In the aqueous solution, sodium hydrosulfite starts to undergo decomposition, for example, according to the following equations, and the decomposition continues until sodium hydrosulfite completely disappears.

$$2S_2O_4^{2-}+H_2O \rightarrow S_2O_3^{2-}+2HSO_3^- \quad (1)$$

$$S_2O_4^{2-}+H_2O+O_2 \rightarrow HSO_3^-+HSO_4^- \quad (2)$$

Equation (1) represents a decomposition equation which is not accompanied with reaction with oxygen, and the decomposition is promoted under an acidic condition.

Ordinary water contains not only oxygen, but also carbon dioxide originating from air in solution, and thus the pH of the ordinary water is at a slight acidic side. That is, equation (1) proceeds.

Equation (2) represents decomposition in the presence of oxygen. When sodium hydrosulfite is dissolved in water in the atmosphere, equation (2) proceeds through contact with air (oxygen) and water. The oxygen dissolved in the water also proceeds the decomposition equation (2). The amounts of $HSO_3^-$ and $HSO_4^-$ in the aqueous sodium hydrosulfite are increased by decomposition of sodium hydrosulfite in the aqueous solution, irrespectively of the decomposition routes of equations (1) and (2), and consequently the acidity of the aqueous solution is increased. As a result, it is seen that $SO_2$ generates from the aqueous sodium hydrosulfite solution, giving a very disagreeable smell. The generation of $SO_2$ by decomposition of the aqueous sodium hydrosulfite solution becomes a problem when the aqueous sodium hydrosulfite solution is left standing, but does not become a problem in the case of dying fibers with a vat dye or reduction cleaning of polyester fibers, because the sodium hydrosulfite is used in the form of an aqueous alkaline solution in the presence of an alkali matter in these applications.

Sodium hydrosulfite is used commercially as suitable bleaching agent for improving the brightness of pulp such as ground pulp, refiner ground pulp, mechanical pulp, etc., and has a reducing ability even under an alkaline condition, but its reducing speed is considerably lower than that under an acidic condition. Thus, in order to bleach pulp efficiently, a condition that a pH of 3 to 7 and a temperature of 40° to 60° C. is usually employed, but generation of $H_2S$ gives a problem in a pulp bleaching process, for example, in apparatuses and steps comprised of a bleaching tower, a chest, a paper machine, etc. $H_2S$ has a disagreeable smell and pollutes the working environment of pulp plant, giving not only sanitary troubles to workers of the plant, but also corrosion of materials of construction in mild steel apparatuses, paper machine, etc., particularly to the screen of a paper machine operated at a high speed.

The hydrosulfite now industrially employed includes a sodium salt and zinc salt, and the zinc hydrosulfite has been so far widely employed, but its consumption has been greatly decreased these days owing to the increased production cost, a problem of waste water treatment when zinc hydrosulfite is used in bleaching, etc.

On the other hand, the application of sodium hydrosulfite has been more and more expanded owing to the recent development and the commercialization of new production processes, such as a sodium formate process, an amalgam process, a boron hydride process, etc. For example, in the pulp bleaching, production of refiner ground pulp (RGP) and thermal mechanical pulp (TMP) is increased owing to the recent change in pulp wood species, and sodium hydrosulfite is preferably used for bleaching these kinds of pulp, that is, for increasing the brightness of pulp.

Sodium hydrosulfite and zinc hydrosulfite are equal to each other in pulp bleaching effect, but are considerably distinguished from each other in decomposition mechanism, especially $H_2S$ generation. It is said that the amount of generated $H_2S$ when zinc hydrosulfite is used in the pulp bleaching is only about 1/50 as large as that when sodium hydrosulfite is used. In a slurry of pulp and sodium hydrosulfite, $H_2S$ generation increases with lowering pH of the slurry. Thus, pH control can be taken into account, but efficient pulp bleaching with a good quality is obtained under a pH of 3 to 7, preferably 5 to 6, and thus it is impossible to prevent the $H_2S$ generation only by pH control.

In these situation, it gives a great advantage to the paper industry using the hydrosulfite to provide a sodium hydrosulfite composition with no $H_2S$ generation when used in pulp bleaching, etc.

As a result of extensive studies in view of these situations, the present inventor has found a novel sodium hydrosulfite composition containing hexamethylene tetramine and a water-soluble sulfite in specific proportions, which will not generate $H_2S$ when used in pulp bleaching, etc. Furthermore, the present inventor has found that a pulp bleaching effect substantially equal to that attained by the commercially available sodium hydrosulfite can be obtained without $H_2S$ generation by using the above-mentioned sodium hydrosulfite composition further containing a polyphosphate.

An object of the present invention is to provide a sodium hydrosulfite composition containing hexamethylene-tetramine (hexamine) and a water-soluble sulfite.

Another object of the present invention is to provide sodium hydrosulfite composition further containing an alkali polyphosphate.

In the present invention, hexamine and a water-soluble sulfite are used together. When hexamine is used alone to completely prevent generation of $H_2S$, it is necessary to add at least 25% by weight of hexamine, on the basis of sodium hydrosulfite, to an aqueous sodium hydrosulfite solution, if the solution has initially a pH of 5. However, hexamine has a negative effect upon the pulp bleaching by sodium hydrosulfite. For example, when hexamine is added to a mixture of sodium hydrosulfite and pulp and subjected to bleaching, brightness of bleached pulp is lowered with increasing proportion of hexamine added. Thus, for the essential purpose of increasing brightness of pulp by bleaching with sodium hydrosulfite, it is desirable to minimize an amount of addition of hexamine. It is neither practical nor economical to add hexamine in a proportion as large as 25% by weight on the basis of sodium hydrosulfite in order to prevent the $H_2S$ generation to an undetectable level.

Single use of water-soluble sulfite cannot attain the effect of the present invention. That is, when sodium sulfite or ammonium sulfite, which is typical of the water-soluble sulfite, is added alone to sodium hydrosulfite, the $H_2S$ generation is reduced only to 40 ppm from 320 ppm of the case no sulfite is added, even by addition of 140% by weight of the sulfite on the basis of sodium hydrosulfite, and the $H_2S$ generation cannot be completely prevented.

The present invention provides a sodium hydrosulfite composition containing 3 to 15% by weight of hexamine and 5 to 15% by weight of a water-soluble sulfite on the basis of the total composition.

The water-soluble sulfite to be used in the present invention includes, for example, sodium sulfite, ammonium sulfite, potasium sulfite, etc. In the present invention, sodium sulfite, ammonium sulfite and potassium sulfite are preferably used.

In the present invention, an effect of preventing the $H_2S$ generation can be obtained by simultaneous use of hexamine and a water-soluble sulfite. However, an effect of bleaching can be improved by adding a polyphosphate to sodium hydrosulfite in addition to the said two components, hexamine and a water-soluble sulfite. That is, an effect of pulp bleaching equal to that by the commercially available sodium hydrosulfite can be obtained in the present invention in addition to the effect of reducing the $H_2S$ generation to an undetectable level.

The polyphosphate to be used in the present invention includes, for example, pyrophosphate represented by $M_2P_4O_7$, where M stands for an alkali metal, tripolyphosphate represented by $M_5P_3O_{10}$, where M has the same meaning as defined above, etc. The amount of the polyphosphate is usually 5 to 20% by weight on the basis of the total composition.

The present sodium hydrosulfite composition includes a solid anhydrous sodium hydrosulfite composition consisting of anhydrous sodium hydrosulfite and said additives, and an aqueous homogenous sodium hydrosulfite composition prepared by adding said additives to an aqueous sodium hydrosulfite solution or prepared by dissolving said sodium anhydrous sodium hydrosulfite composition in water.

The present sodium hydrosulfite composition is applicable to bleaching of the ordinary wood pulp. The wood pulp includes ground pulp (GP), refiner ground pulp (RGP), thermomechanical pulp (TMP), etc. The present sodium hydrosulfite composition is also applicable to bleaching of waste paper pulp (WP), etc. without any trouble. In order to obtain optimum bleaching conditions (temperature, pH and time) for individual pulp, amounts of the water-soluble sulfite, hexamine and polyphosphate in the present sodium hydrosulfite composition can be freely selected within said ranges. When it is necessary to make a bleaching pH lower than the standard, or to make a bleaching time longer the standard, or to maintain a bleaching temperature higher than the standard, the amounts of the water-soluble sulfite and hexamine in the present sodium hydrosulfite composition can be increased within said ranges.

Testing procedures used in the following examples will be described below.

1. Testing procedure for determining $H_2S$

Water is placed in a glass bottle provided with pH electrodes connected to a pH meter, an inlet for 1/10 N sulfuric acid, a rubber tube for gas aspiration, and a warm water aspirator for preventing the bottle from pressure reduction at the aspiration of gas and also for allowing the gas to be aspirated under a constant pressure, and also provided with a stirrer member for a magnetic stirrer within the bottle. Additives, when added, are dissolved in the water in the bottle. Sodium hydrosulfite to be subjected to $H_2S$ test is so weighed and added to the bottle that an initial concentration of sodium hydrosulfide as dissolved can be 850 ppm. Then, a stopper is quickly fixed to the bottle, and 1/10 N sulfuric acid is fed to the bottle with gentle stirring to quickly adjust pH to 5 or 5.5 (standard). Then, the glass bottle is dipped in a thermostat water tank kept at 50° C. and left standing therein for 60 minutes as the standard time. A constant volume of the gas in the space in the glass bottle is aspirated through Kitagawa $H_2S$ detector tube type 120C (direct read type of a $H_2S$ concentration of 50 to 1,600 ppm without disturbance by coexisting $SO_2$). Since the inside pressure of the bottle is reduced at the gas aspiration, warm water of 50° C. is made to be aspirated at the same time by utilizing the reduced inside pressure of the bottle, so that the gas can be passed through the $H_2S$ detector tube under a constant pressure at a constant volume. $H_2S$ concentration (ppm by volume) in the space of the bottle (space column: 390 ml constant) is determined by measuring the length of colored portion of the detector tube. According to this procedure, pH adjustment and $H_2S$ determination can be simply and precisely carried out. The initial concentration of sodium hydrosulfite, 850 ppm, corresponds to an initial concentration of sodium hydrosulfite (on the basis of pulp slurry) when pulp is bleached at a pulp consistency of 5% by weight and at a ratio of sodium hydrosulfite added to the dry pulp of 1.6% by weight. This condition can be considered as typical one of hydrosulfite bleaching used in pulp and paper mills. Test pH, temperature and time are also in accordance with the typical conditions for pulp bleaching used in pulp and paper mills of RGP, TMP, etc.

2. Testing procedure for pulp bleaching

Potable water (or water containing 2 ppm iron) is added to unbleached pulp such as GP, TMP, etc. to make a uniform pulp slurry having a pulp consistency of 5% by weight. Aluminum sulfate is added thereto to make a pH of 5.0–5.5, and a sodium hydrosulfite composition to be subjected to the bleaching test is added thereto at a level of 1 to 2% by weight on the basis of dry pulp, and quickly and uniformly dispersed and dissolved. Bleaching is carried out in the absence of air at 50° C. for one hour. The bleached pulp is made into pulp leaf according to the standard method, and its brightness is measured by Hunter whiteness meter.

The reason why the individual decomposition test of an aqueous hydrosulfite solution at the same hydrosulfite initial concentration—pH—temperature—time as in the pulp bleaching condition is used as the testing procedure for determining $H_2S$ in place of the hydrosulfite bleaching test of pulp is given below.

When pulp was bleached in the absence of air in a vessel made from a film having a very high gas barrier ability, for example KOP film, to prevent the pulp slurry from contact with the atmosphere in said testing procedure for pulp bleaching, $H_2S$ generation was investigated by means of the $H_2S$ detector tube. The $H_2S$ generation was very small per 25 to 50 g of pulp, as shown in Table 1, and the determined values were also fluctuated.

It is seen thus that only a small amount of $H_2S$ is generated from the hydrosulfite when pulp bleaching is carried out in the complete absence of air. However, this is quite inconsistent with the problem of $H_2S$ generation in the industrial scale pulp bleaching process. In the industrial scale bleaching process, hydrosulfite bleaching of pulp is generally carried out in a bleaching tower. A slurry of pulp and hydrosulfite solution at some consistency is charged into the bleaching tower. There is air in the bleaching tower. The type of bleaching tower can be classified into an upflow type and a downflow type. Especially in the case of downflow type, the pulp slurry containing the hydrosulfite has a chance to contact the air until the pulp passes through the bleaching tower from the top to the standard level of the bleaching tower. In the case of upflow type, there is no chance to contact the air at the inlet of the bleaching tower, but the pulp can contact the air at the overflow after retained in the bleaching tower for a specific period of time. Thus, the pulp bleaching test in the absence of air for determining a concentration of $H_2S$ generated from a sodium hydrosulfite composition is not appropriate owing to the discrepancy in conditions between the testing procedure and the actual bleaching process at the mill site.

The present invention conducted bleaching by sealing a specific volume of air into the space above the pulp containing the hydrosulfite in the testing procedure for bleaching pulp of said item 2, and found that $H_2S$ was generated in such an amount as to be determined by the $H_2S$ detector tube very precisely, as shown in Table 2. That is, it is seen that the presence of air (oxygen) contributes to the generation of $H_2S$ from the hydrosulfite solution, and that the pulp bleaching in laboratory scale with the presence of air is suitable for reproducing conditions in an industrial scale hydrosulfite pulp-bleaching tower in order to know $H_2S$ generation. However, the laboratory pulp bleaching in the presence of air gives a color reversion of bleached pulp so that the brightness of bleached pulp cannot be determined precisely.

The present inventor thus conducted the test of $H_2S$ generation from hydrosulfite and the test of pulp bleaching separately. In the $H_2S$ test, a concentration of $H_2S$ generated by decomposition of the aqueous hydrosulfite solution was determined, as described above. This testing procedure for determining $H_2S$ is a much severe condition as regards the $H_2S$ generation, because the hydrosulfite is substantially completely decomposed, and if a sodium hydrosulfite composition effective for preventing the $H_2S$ generation can be testified according to this testing procedure, an application of such a composition to industrial pulp bleaching can assure the prevention of $H_2S$ generation, because in the application of sodium hydrosulfite or a sodium hydrosulfite composition to pulp bleaching most of sodium hydrosulfite performs a normal reducing action ($H_2S$ is generated not by the normal reducing action of sodium hydrosulfite, but by decomposition of sodium hydrosulfite), and consequently generation of $H_2S$ by decomposition of sodium hydrosulfite is reduced thereby.

TABLE 1

| Hydrosulfite | $H_2S$ concentration (ppm) 1 | 2 | 3 | 4 |
|---|---|---|---|---|
| 85% purity sodium hydrosulfite | 0 | 20 | 50 | 10 |
| 85% purity sodium hydrosulfite + STPP* (14%) | 20 | 30 | 10 | 40 |
| Zinc hydrosulfite | 0 | 10 | 0 | 20 |
| Present composition (Example 4) | 0 | 10 | 0 | 0 |

*STPP = Sodium tripolyphosphate
Hydrosulfite addition to dry pulp: 2% by weight

TABLE 2

| Hydrosulfite | $H_2S$ concentration (ppm) |
|---|---|
| 85% purity sodium hydrosulfite | 100 |
| 85% purity sodium hydrosulfite + STPP* (14%) | 90 |
| Present composition (Example 2) | 10 |
| Present composition (Example 4) | 0 |

*STPP = Sodium tripolyphosphate
Hydrosulfite addition to dry pulp: 2% by weight

EXAMPLE 1

Hexamine, sodium sulfite and sodium tripolyphosphate (STPP) were added to commercially available 90% purity sodium hydrosulfite so that hexamine, sodium sulfite and STPP can be in amounts of 5% by weight each in the resulting composition, and uniformly mixed, whereby an anhydrous sodium hydrosulfite composition having a 76% sodium hydrosulfite purity was obtained. The resulting composition was subjected to determination of $H_2S$ generation according to said testing procedure, and it was found that the concentration of $H_2S$ was 1/6 to 1/10 times that in the case of sodium hydrosulfite without addition of above said additives. Two kinds of unbleached pulp, i.e. GP and TMP were bleached by the thus prepared composition at two levels of addition of the composition i.e. 1% and 2% by weight on dry pulp according to said testing procedure, and it was found that an equivalent bleaching effect to that of the commercially available sodium hydrosulfite was obtained. The results are shown in Table 3.

EXAMPLE 2

Hexamine, sodium sulfite and STPP were added to commercially available 90% purity sodium hydrosulfite so that hexamine, sodium sulfite and STPP can be in amounts of 6.5% by weight each in the resulting composition, and uniformly mixed, whereby an anhydrous sodium hydrosulfite composition having a 73% sodium hydrosulfite purity was obtained. $H_2S$ generation by decomposition of the composition was determined according to said testing procedure, and found to be 1/6 to 1/10 times that in the case of sodium hydrosulfite without addition of the said additives. Two kinds of unbleached pulp, i.e. GP and TMP, were bleached by the thus prepared composition at two levels of addition of the composition i.e. 1% and 2% by weight on dry pulp according to said testing procedure, and it was found that an equivalent bleaching effect to that of the commercially available sodium hydrosulfite was obtained. The results are shown in Table 3.

EXAMPLE 3

Hexamine, sodium sulfite and STPP were added to commercially available 90% purity sodium hydrosulfite so that hexamine, sodium sulfite and STPP can be in amounts of 7.7% by weight each in the resulting composition, and uniformly mixed, whereby an anhydrous sodium hydrosulfite composition having a 69% sodium hydrosulfite purity was obtained.

Generation of $H_2S$ by decomposition of the composition was determined according to said testing procedure, and found to be reduced to 1/30 times that in the case of the sodium hydrosulfite without addition of the said additives, or no $H_2S$ was detected. Two kinds of unbleached pulp, i.e. GP and TMP, were bleached by the thus prepared composition at two levels of addition of the composition i.e. 1% and 2% by weight on dry pulp according to said testing procedure, and it was found that an equivalent bleaching effect to that of the commercially available sodium hydrosulfite was obtained. The results are shown in Table 3.

EXAMPLE 4

Hexamine, sodium sulfite and STPP were added to commercially available 90% purity sodium hydrosulfite so that hexamine, sodium sulfite and STPP can be in amounts of 8.8% by weight each in the resulting composition, and uniformly mixed, whereby an aqueous sodium hydrosulfite composition having a 65% sodium hydrosulfite purity was obtained.

$H_2S$ generation by decomposition of the composition was determined according to said testing procedure, and was found to be reduced to 1/30 times that in the case of sodium hydrosulfite without addition of the said additives, or no $H_2S$ was detected. Two kinds of unbleached pulp, i.e. GP and TMP, were bleached with the thus prepared composition at two levels of addition of the composition i.e. 1% and 2% on dry pulp, according to said testing procedure, and it was found that an equivalent bleaching effect to that of the commercially available sodium hydrosulfite was obtained. The results are shown in Table 3.

EXAMPLE 5

Hexamine, and sodium sulfite were added to commercially available 85% purity sodium hydrosulfite so that hexamine and sodium sulfite can be in amounts of 7% and 10% by weight respectively in the resulting composition, and the thus prepared composition was subjected to determination of $H_2S$ generation according to said testing procedure, and it was found that 30 ppm of $H_2S$ was generated, and the $H_2S$ generation was reduced to 1/10 times that in the case of sodium hydrosulfite without addition of the said additives.

EXAMPLE 6

Hexamine and ammonium sulfite were added to commerically available 85% purity sodium hydrosulfite so that hexamine and ammonium sulfite can be in amounts of 5% and 7% by weight respectively in the resulting composition. The thus prepared composition was subjected to determination of $H_2S$ generation according to said testing procedure, and it was found that 30 ppm of $H_2S$ was generated, and the $H_2S$ generation was reduced to 1/10 times that in the case of sodium hydrosulfite without addition of the said additives.

TABLE 3

| | $H_2S$ generation ($H_2S$ [ppm]) | | | Pulp bleaching [brightness (points)] | | |
|---|---|---|---|---|---|---|
| Example | pH 5, 50° C., 60 min. | pH 5.5, 50° C., 60 min. | pH 5.5, 50° C., 60 min. | Pulp kind | 1% by weight added | 2% by weight added |
| Example 1 | 50 | 30 | 30 | GP | 57.6 | 59.6 |
| | | | | TMP | 57.4 | 59.2 |
| Example 2 | 50 | 30 | 30 | GP | 57.7 | 59.7 |
| | | | | TMP | 57.2 | 59.2 |
| Example 3 | 0 | 10 | 0 | GP | 56.7 | 59.5 |
| | | | | TMP | 57.4 | 59.2 |
| Example 4 | 0 | 0 | 10 | GP | 56.6 | 59.2 |
| | | | | TMP | 57.2 | 58.8 |
| Example 5 | 30 | | | | | |
| Example 6 | 30 | | | | | |

Results of bleaching tests of pulp by commercially available 85% purity sodium hydrosulfite containing no hexamine, sodium sulfite or STPP, that is, single sodium hydrosulfite as compared with the results shown in Table 3, are given in Table 4.

TABLE 4

| Pulp kind | Sodium hydrosulfite added on basis of dry pulp (% by weight) | Brightness (points) |
|---|---|---|
| GP | 1 | 57.1 |
| GP | 2 | 59.5 |
| TMP | 1 | 57.7 |
| TMP | 2 | 59.4 |

Comparative Example 1

$H_2S$ generation test of commercially available anhydrous sodium hydrosulfite and its formulations.

Results of $H_2S$ generation test under a condition of initial pH 5°-50° C.—60 min. according to said testing procedure are shown in Table 5.

TABLE 5

| Sodium hydrosulfite | Additive | $H_2S$ concentration (ppm) |
|---|---|---|
| 85% | sodium carbonate (75%) | 320 |
| 90% | sodium carbonate (2%) | 300 |
| 89% | sodium carbonate (3%) | 420 |
| 70% | sodium carbonate (24%) | 320 |
| 65% | sodium bicarbonate (29%) | 250 |
| Zinc hydrosulfite | — | 50 |

It is seen from Table 5 that $H_2S$ is generated from commercially available anhydrous sodium hydrosulfite, and additives usually used for prolonging the storage life (stabilization) of sodium hydrosulfite such as sodium carbonate and sodium bicarbonate has no effect upon preventing the $H_2S$ generation. On the other hand, it is seen that the concentration of $H_2S$ generated from zinc hydrosulfite is considerably small, and this result is in good agreement with the results reported by pulp mills that $H_2S$ generation is considerably smaller in the case of zinc hydrosulfite than in the case of sodium hydrosulfite.

Comparative Example 2

Test of adding water-soluble sulfite

Results of determining $H_2S$ concentrations when anhydrous sodium sulfite was added to commercially available 85% purity sodium hydrosulfite are shown in Table 6.

TABLE 6

| | | | | | |
|---|---|---|---|---|---|
| $Na_2SO_3$ added (%) | 5 | 15 | 25 | 40 | 70 |
| Initial pH | 5 | 5 | 5 | 5 | 5 |
| $H_2S$ concentration (ppm) | 200 | 120 | 90 | 60 | 45 |

$H_2S$ generation could not be prevented completely to an undetectable level even by adding as much as 70% $Na_2SO_3$ to sodium hydrosulfite.

Comparative Example 3

Test of adding hexamethylenetetramine

Results of determining $H_2S$ generation when hexamine was added to commercially available 85% purity sodium hydrosulfite are shown in Table 7.

TABLE 7

| | | | | | |
|---|---|---|---|---|---|
| Hexamine added (%) | 10 | 15 | 20 | 25 | 30 |
| $H_2S$ concentration (ppm) | 150 | 180 | 75 | 10 | 0 |

Reduction of $H_2S$ generation to an undetectable level was possible by adding at least 25% by weight of hexamine to 85% purity sodium hydrosulfite.

What is claimed is:

1. A bleaching sodium hydrosulfite composition which minimizes $H_2S$ generation in use and which comprises sodium hydrosulfite, 3 to 15% by weight of hexamethylenetetramine and 5 to 15% by weight of a water-soluble sulfite selected from the group consisting of sodium sulfite, ammonium sulfite and potassium sulfite.

2. A bleaching composition according to claim 1, wherein a polyphosphate is further contained.

3. A bleaching composition according to claim 2, wherein 5 to 20% by weight of the polyphosphate is contained in the composition.

4. A bleaching composition according to claim 1, wherein the composition is in a solid state.

5. A bleaching composition according to claim 1, wherein the composition is in an aqueous solution.

6. A method of using a bleaching composition of any one of claims 1 to 5 in bleaching pulp.

* * * * *

REEXAMINATION CERTIFICATE (333rd)

United States Patent [19]
Yamaguchi
[11] B1 4,357,256
[45] Certificate Issued Apr. 2, 1985

[54] SODIUM HYDROSULFITE COMPOSITION

[75] Inventor: Takaaki Yamaguchi, Tokyo, Japan

[73] Assignee: Mitsubishi Gas Chemical Company, Inc., Tokyo, Japan

Reexamination Request:
No. 90/000,547, Apr. 20, 1984

Reexamination Certificate for:
Patent No.: 4,357,256
Issued: Nov. 2, 1982
Appl. No.: 128,098
Filed: Mar. 7, 1980

[30] Foreign Application Priority Data
Mar. 13, 1979 [JP] Japan ..... 54-29186

[51] Int. Cl.³ ..... C09K 3/00
[52] U.S. Cl. ..... 252/188.24; 162/83; 162/80; 8/107; 8/110; 423/512 R; 423/515
[58] Field of Search ..... 8/107, 110; 162/72, 162/80, 83; 252/188.22, 188.24; 423/512 R, 515

[56] References Cited

U.S. PATENT DOCUMENTS 2,707,144 4/1955 Sparrow ..... 8/104
2,963,395 12/1960 Back ..... 162/83
3,653,804 4/1972 Janson et al. ..... 8/110
3,669,895 6/1972 Shastri ..... 252/188
3,960,649 6/1976 Sullivan ..... 162/72

OTHER PUBLICATIONS

Ingruber and Kopanidis, "Hydrosulfite Bleaching", Pulp Paper Mag. Canada 66, T258-276, (1967).
Danehy and Zubritsky III, "Iodometric Method for the Determination of Dithionite, Bisulfite, and Thiosulfate in the Presence of Each Other and Its Use in Following the Decomposition of Aqueous Solutions of Sodium Dithionite", Anal. Chem. 46 (3), 391-395, (1974).
Gupta and Mutton, "Use of Sequestering Agents in Deionization and Hydrosulphite Bleaching of Groundwood", Pulp Paper Mag. Canada, 70 T174, (1969).
Ganguli, "Sodium Hydrosulfite Bleaching of TMP Improved with Metal Chelants", Pulp and Paper, pp. 108-112, Oct. 1980.
Hart, "Mechanical Pul Bleaching Costs Cut with Proper Use of Chelating Agents", Pulp and Paper, pp. 138-140, Jun. 1981.

*Primary Examiner*—Dennis L. Albrecht

[57] ABSTRACT

A bleaching composition comprises sodium hydrosulfite, hexamethylenetetramine and a water soluble sulfite such as sodium sulfite or ammonium sulfite, or further a polyphosphate such as a pyrophosphate or a tripolyphosphate and is used in bleaching pulp with a good bleaching effect with no substantial hydrogen sulfide generation.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–6 are cancelled.

* * * * *